US011161164B2

(12) United States Patent
Serizawa et al.

(10) Patent No.: US 11,161,164 B2
(45) Date of Patent: Nov. 2, 2021

(54) METHOD FOR MANUFACTURING A PRESS-MOLDED ARTICLE, A RETAINER, AND A MANUFACTURING SYSTEM FOR A PRESS-MOLDED ARTICLE

(71) Applicant: UNIPRES CORPORATION, Kanagawa (JP)

(72) Inventors: Tsutomu Serizawa, Tokyo (JP); Ryo Gawasawa, Tokyo (JP)

(73) Assignee: UNIPRES CORPORATION, Kanagawa (JP)

( * ) Notice: Subject to any disclaimer, the term of this patent is extended or adjusted under 35 U.S.C. 154(b) by 0 days.

(21) Appl. No.: 17/037,758

(22) Filed: Sep. 30, 2020

(65) Prior Publication Data

US 2021/0008609 A1 Jan. 14, 2021

Related U.S. Application Data

(63) Continuation of application No. PCT/JP2018/040534, filed on Oct. 31, 2018.

(30) Foreign Application Priority Data

Oct. 10, 2018 (JP) ..... JP2018-191744

(51) Int. Cl.
*B21D 22/20* (2006.01)
*B21D 37/16* (2006.01)
(Continued)

(52) U.S. Cl.
CPC ..... *B21D 22/208* (2013.01); *B21D 37/16* (2013.01); *C21D 1/26* (2013.01); *C21D 1/34* (2013.01); *C21D 2221/00* (2013.01)

(58) Field of Classification Search
CPC .... B21D 22/208; B21D 37/16; B21D 22/022; B21D 24/00; C21D 1/26; C21D 1/34; C21D 2221/00; C21D 1/18
(Continued)

(56) References Cited

U.S. PATENT DOCUMENTS 8,118,954 B2 * 2/2012 Beenken ..... B21D 22/022 148/714
8,349,100 B2 * 1/2013 Sunaga ..... B21D 22/02 148/654
(Continued)

FOREIGN PATENT DOCUMENTS

CN 101439382 A 5/2009
CN 102304612 A 1/2012
(Continued)

OTHER PUBLICATIONS

Notice of First Office Action for Patent Application No. 201880072590.5, issued by The National Intellectual Property Administration of the People's Republic of China dated Oct. 12, 2020.
(Continued)

*Primary Examiner* — Scott R Kastler
*Assistant Examiner* — Michael Aboagye

(57) ABSTRACT

A method for manufacturing a press-molded article may include molding a blank material which is a steel plate into a press-molded article by sandwiching the blank material between a first molding surface and a second molding surface of a die, and press-molding the blank material into a predetermined shape. The method for manufacturing a press-molded article may include irradiating a predetermined portion of the press-molded article with infrared light after removing the press-molded article from the die.

8 Claims, 3 Drawing Sheets

(51) Int. Cl.
*C21D 1/26* (2006.01)
*C21D 1/34* (2006.01)

(58) Field of Classification Search
USPC ..... 72/364, 362, 363, 342.94, 342.1, 342.4, 72/342.5, 342.6
See application file for complete search history.

(56) References Cited

U.S. PATENT DOCUMENTS

| | | | | |
|---|---|---|---|---|
| 9,291,977 | B1 | 3/2016 | Kitamura | |
| 10,000,823 | B2 | 6/2018 | Hartmann | |
| 10,954,579 | B2 | 3/2021 | Skrikerud | |
| 2008/0196800 | A1 | 8/2008 | Xu | |
| 2012/0060982 | A1* | 3/2012 | Bohner | C21D 1/673 148/653 |
| 2015/0016810 | A1 | 1/2015 | Mineoka | |
| 2019/0119768 | A1* | 4/2019 | Schleichert | C21D 1/34 |

FOREIGN PATENT DOCUMENTS

| | | | | | |
|---|---|---|---|---|---|
| CN | 102397942 | A | | 4/2012 | |
| CN | 102527803 | A | | 7/2012 | |
| CN | 102554040 | A | | 7/2012 | |
| CN | 102688944 | A | | 9/2012 | |
| CN | 103382518 | A | | 11/2013 | |
| CN | 103934360 | A | | 7/2014 | |
| CN | 103998630 | A | | 8/2014 | |
| CN | 104011228 | A | | 8/2014 | |
| CN | 105149428 | A | | 12/2015 | |
| CN | 105234264 | A | | 1/2016 | |
| CN | 108138249 | A | | 6/2018 | |
| JP | 2011173166 | | * | 9/2011 | B21D 22/208 |
| JP | 2011173166 | A | | 9/2011 | |
| JP | 2016041440 | A | | 3/2016 | |
| JP | 2016088665 | A | | 5/2016 | |
| JP | 2017190220 | A | | 10/2017 | |
| WO | 2016088665 | A1 | | 6/2016 | |
| WO | 2017190220 | A1 | | 11/2017 | |
| WO | WO2017190220 | | * | 11/2017 | B21D 22/208 |

OTHER PUBLICATIONS (ISA/237) Written Opinion of the International Search Authority for International Patent Application No. PCT/JP2018/040534, mailed by the Japan Patent Office dated Jan. 22, 2019.

Office Action issued for counterpart Japanese Application No. 2019-540464, issued by the Japanese Patent Office dated Nov. 12, 2019 (drafted on Nov. 6, 2019).

Decision to Grant a Patent issued for counterpart Japanese Application No. 2019-540464, issued by the Japanese Patent Office dated Feb. 4, 2020 (drafted on Jan. 28, 2020).

Notice of Third Office Action for Patent Application No. 201880072590.5, issued by The National Intellectual Property Administration of the People's Republic of China dated Jul. 21, 2021.

* cited by examiner

400

METHOD FOR MANUFACTURING A PRESS-MOLDED ARTICLE, A RETAINER, AND A MANUFACTURING SYSTEM FOR A PRESS-MOLDED ARTICLE

CROSS REFERENCE TO RELATED APPLICATION

The contents of the following Japanese patent applications are incorporated herein by reference:

No. 2018-191744 filed in JP on Oct. 10, 2018 and

No. PCT/JP2018/040534 filed on Oct. 31, 2018.

BACKGROUND

1. Technical Field

The present invention relates to a method for manufacturing a press-molded article, a retainer, and a manufacturing system for a press-molded article.

2. Related Art

Patent document 1 describes heating and annealing a portion of a hot stamped article with a laser. Patent document 2 describes a method for manufacturing a component having a rigid zone and a soft zone by sandwiching and deforming a heated blank with a die assembly and cooling a first portion of the blank while heating a second portion of the blank with an infrared lamp.

Patent document 1: International Publication No. WO2016/088665

Patent document 2: International Publication No. WO2017/190220

DESCRIPTION OF EXEMPLARY EMBODIMENTS

Hereinafter, the invention will be described through embodiments of the invention, but the following embodiments do not limit the invention according to the claims. In addition, not all combinations of the features described in the embodiments are necessarily essential to the solution of the invention.

Figure 1:
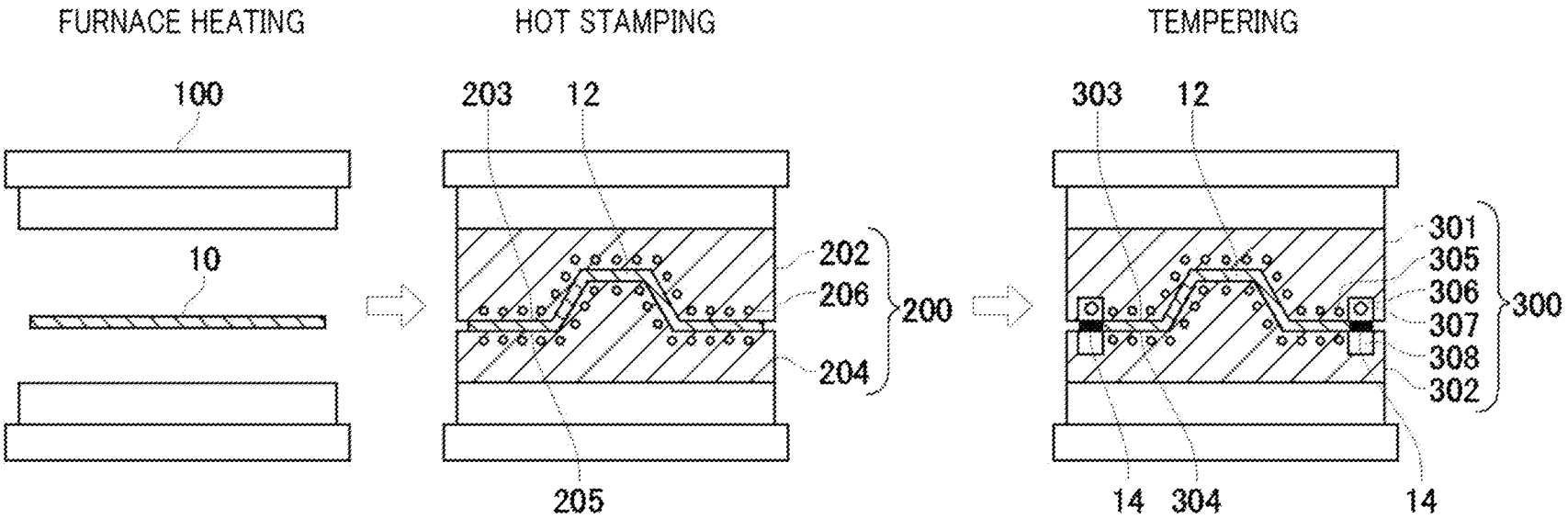
FIG. 1 describes a method for manufacturing a press-molded article.

FIG. 1 describes a method for manufacturing a press-molded article according to the present embodiment. At the heating step, a blank material 10 which is a steel plate is heated to a temperature in an austenite region (for example, a temperature of 850 degrees or higher, preferably from 900 degrees Celsius to 1000 degrees Celsius) in a heating furnace 100. The heated blank material 10 is removed from the heating furnace 100 and is set in a die 200.

At the hot stamping step, the heated blank material 10 is cooled until martensitic transformation occurs, while being press-molded using the die 200.

The die 200 includes an upper die 202 having a molding surface 203 and a lower die 204 having a molding surface 205. The molding surface 203 is an example of a first molding surface. The molding surface 205 is an example of a second molding surface. The die 200 has a flow path 206 for delivering a coolant, such as water, to cool the blank material 10, along the molding surface 203 and the molding surface 205. The heated blank material 10 is sandwiched between the molding surface 203 and the molding surface 205 to be press-molded into a predetermined shape. While being press-molded, the blank material 10 is cooled by the coolant delivered through the flow path 206 with the blank material 10 sandwiched between the molding surface 203 and the molding surface 205. The blank material 10 is molded into a press-molded article 12 by the above-mentioned hot stamping step. The press-molded article 12 has strength of 1.2 GPa to 1.8 GPa, for example.

Then, at the tempering step or the annealing step, the press-molded article 12 removed from the die 200 is set into a retainer 300 and a predetermined portion 14 of the press-molded article 12 is irradiated with infrared light. In this way, the predetermined portion 14 is softened. That is, the predetermined portion 14 of the press-molded article 12 is subject to tempering or annealing, by irradiating the predetermined portion 14 of the press-molded article 12 with infrared light.

The retainer 300 includes an upper die 301 having a retaining surface 303 along the shape of one surface of the press-molded article 12, and a lower die 302 having a retaining surface 304 along the shape of the other surface on the opposite side of said one surface of the press-molded article 12. The retainer 300 has a flow path 305 for delivering a coolant, such as water, to cool the press-molded article 12, along the retaining surface 303 and the retaining surface 304. The retainer 300 has a recess 306 and a recess 308 in regions of the retaining surface 303 and the retaining surface 304 opposed to the portion 14 of the press-molded article 12. The recess 306 and the recess 308 are examples of a first recess and a second recess. The recess 306 and the recess 308 may be grooves provided on the retaining surface 303 and the retaining surface 304. Note that, the retainer 300 may not have the flow path 305.

An infrared heater 307 for irradiating the portion 14 of the press-molded article 12 with infrared light is provided in the recess 306 of the upper die 301. The infrared heater 307 is an example of a first infrared irradiating unit. The infrared heater 307 may irradiate the portion 14 of the press-molded article 12 with near-infrared light. The retainer 300 may have an infrared lamp instead of the infrared heater. The retainer 300 may have a plurality of infrared heaters disposed along the portion 14. The retainer 300 may have a plurality of infrared lamps arranged along the portion 14. The near-infrared light may be electromagnetic waves with a wavelength of 0.7 to 2.5 micrometers. The width of the recess 308 may be a width corresponding to the width of the portion 14. The recess 308 may function as a shielding wall for shielding infrared light to prevent portions other than the portion 14 of the press-molded article 12 from being irradiated with the infrared light irradiated from the infrared heater 307. In addition, by providing the recess 308, the air inside the recess 308 functions as a heat insulation layer to suppress heat radiation through the lower die 302 of the heat in the portion 14 of the press-molded article 12 heated by the infrared light from the infrared heater 307.

The retainer 300 may also have an infrared heater in the recess 308 to heat the portion 14 of the press-molded article 12 from both sides. The infrared heater provided in the recess 308 is an example of a second infrared irradiating unit.

For example, the press-molded article 12 is an automobile frame component or the like. The automobile frame component may be softened by partially reducing its strength. In this way, in case of a motor vehicle collision, the softened portion can deform and absorb the collision energy. By partially softening the press-molded article 12 as described above, the safety of passengers on the motor vehicle can be ensured.

The wavelength range of the infrared light irradiated by the infrared heater 307 is wider than the wavelength range of a laser light irradiated by a laser as in Patent document 1. Therefore, the portion 14 to be softened of the press-molded article 12 can be irradiated with light having various wavelengths. As such, the absorption of light with which the portion 14 of the press-molded article 12 is irradiated can be facilitated. That is, the portion 14 of the press-molded article 12 can be efficiently heated and softened. The laser light is irradiated locally. On the other hand, infrared light irradiated by the infrared heater 307 is irradiated over a wide range. Therefore, the productivity of softening process of the portion 14 of the press-molded article 12 can be improved.

In addition, the portion 14 is heated by irradiating with infrared light from the infrared heater 307, with the press-molded article 12 sandwiched between the retaining surface 303 of the upper die 301 and the retaining surface 304 of the lower die 302. In this way, the portion 14 of the press-molded article 12 can be accurately softened while suppressing deformation of the press-molded article 12. Deformation of the press-molded article 12 can be further suppressed and the portion 14 of the press-molded article 12 can be more accurately softened by heating the portion 14 by irradiating the portion 14 with infrared light from the infrared heater 307 while cooling portions other than the portion 14 to be softened of the press-molded article 12, with the press-molded article 12 sandwiched between the retaining surface 303 of the upper die 301 and the retaining surface 304 of the lower die 302.

Deformation due to heat by infrared irradiation can be more certainly suppressed by irradiating the entire press-molded article 12 with infrared light, with the entire press-molded article sandwiched between the retaining surface 303 of the upper die 301 and the retaining surface 304 of the lower die 302.

Moreover, portions other than the portion 14 of the press-molded article 12 is cooled by a coolant delivered through the flow path 305, while the portion 14 of the press-molded article 12 is irradiated with infrared light. In this way, the transition width of the hardness at a boundary portion between the portion 14 to be softened and other portions whose hardness are to be maintained may be narrowed.

Note that, in the present embodiment, an example is shown in which the entire portion other than the portion 14 of the press-molded article 12 is cooled. However, instead of the entire portion other than the portion 14 of the press-molded article 12, only portions around the portion 14 of the press-molded article 12 may be cooled. In addition, the press-molded article 12 may not be cooled while being irradiated with infrared light.

In addition, as described in Patent document 2, when infrared light is irradiated at the hot stamping step, portions that can be irradiated with infrared light is limited to flat portions that are not deformed by press-molding. That is, when infrared light is irradiated at the hot stamping step, the portions deformed by press-molding cannot be softened. In addition, when a steel plate heated to a temperature in an austenite region or higher is rapidly cooled and partially heated at the same time, the position of the portion to be softened shifts by the amount of contraction of the steel plate upon rapid cooling. Due to such shift in the position, the stability of the shape of the press-molded article becomes lower, and the transition width of the hardness at the boundary portion between the portion to be softened and the portion not to be softened becomes wider.

As described above, according to the present embodiment, regions of any size at any location of the press-molded article can be efficiently softened.

Figure 2:
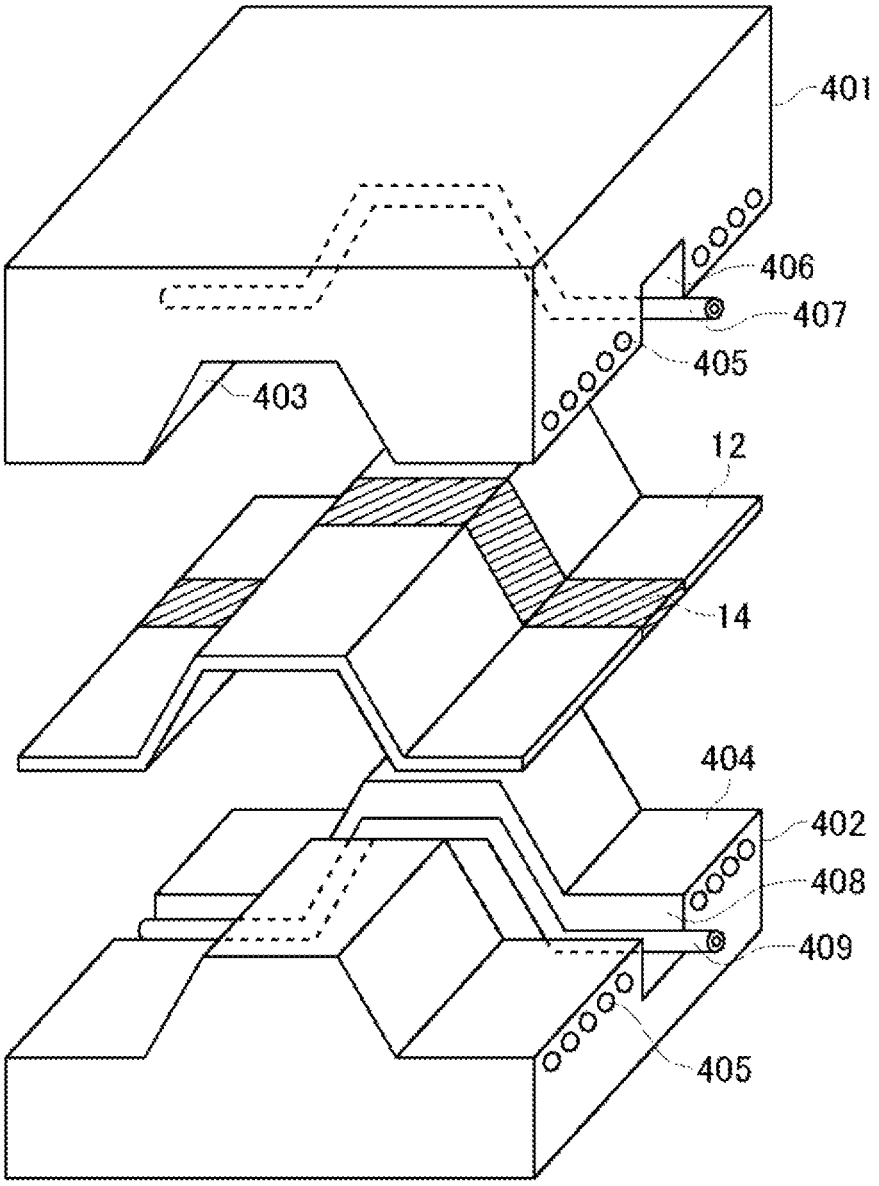
FIG. 2 describes another example of a retainer used in the tempering step or the annealing step.

FIG. 2 describes another example of a retainer used in the tempering step or the annealing step. The retainer 400 has an infrared irradiating function and a cooling function. The retainer 400 includes an upper die 401 having a retaining surface 403 with a shape along one surface of the press-molded article 12, and a lower die 402 having a retaining surface 404 with a shape along the other surface of the press-molded article 12. The upper die 401 has a recess 406 in a region opposed to the portion 14 to be softened of the press-molded article 12. An infrared heater 407 for irradiating infrared light from the side of one surface of the portion 14 is provided in the recess 406. Similarly, the lower die 402 has a recess 408 in a region opposed to the portion 14 to be softened of the press-molded article 12. An infrared heater 409 for irradiating infrared from the side of the other surface of the portion 14 is provided in the recess 408. The upper die 401 and the lower die 402 have a flow path 405 for delivering a coolant, along the retaining surface 403 and the retaining surface 404.

The infrared heater 407 and the infrared heater 409 can be deformed into any shape and disposed. Therefore, as shown in FIG. 2, the portion 14 to be softened of the press-molded article 12 can be heated using the infrared heater 407 and the infrared heater 409, even when the portion is a portion along a hat-shaped cross section. By adjusting the number and thickness of the infrared heaters, the portion 14 to be softened can be heated at a time, without restriction on the size of the portion's area. Even when the portions 14 to be softened are scattered, the portions can be heated at a time. The press-molded article 12 is sandwiched between the retaining surface 403 of the upper die 401 and the retaining surface 404 of the lower die 402, while being heated with the infrared heaters 407 and 408. Therefore, deformation of the press-molded article 12 due to heating can be further certainly suppressed.

Figure 3:
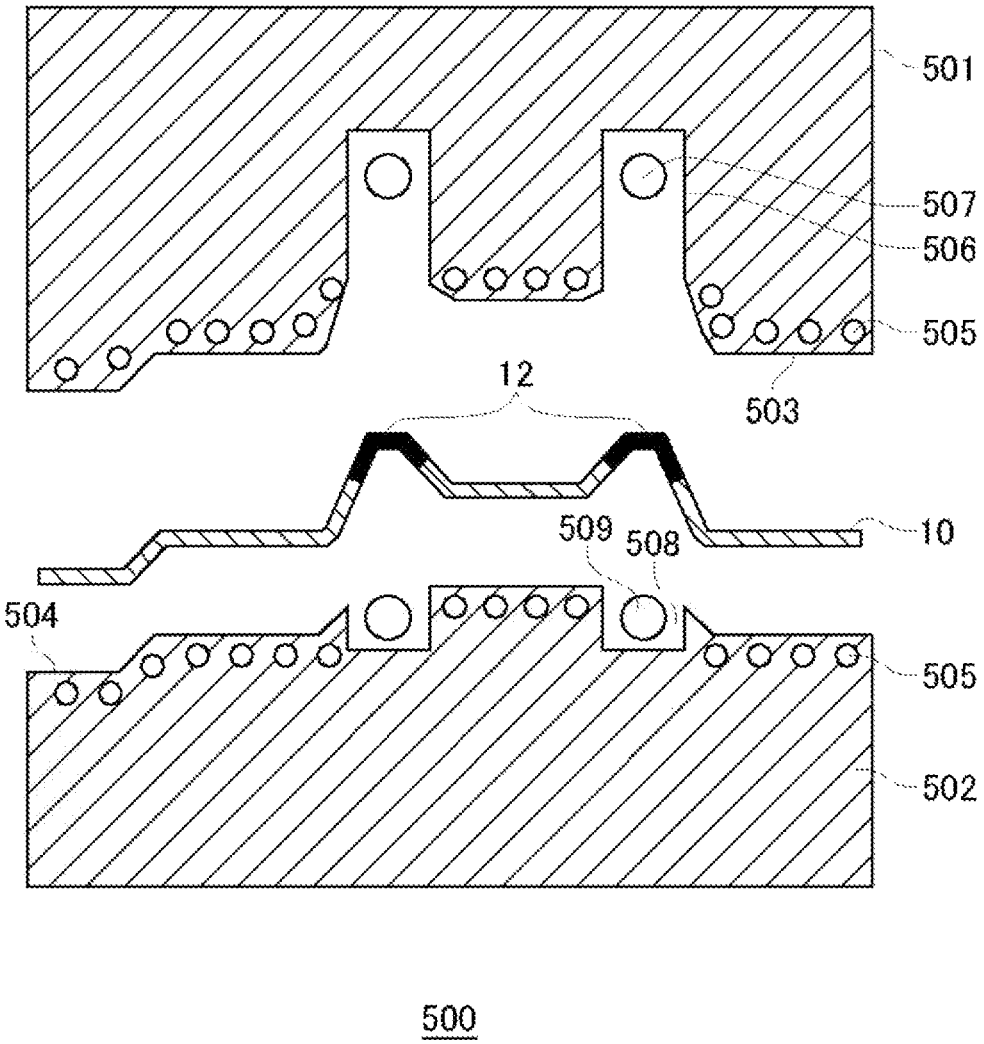
FIG. 3 describes another example of a retainer used in the tempering step or the annealing step.

FIG. 3 describes another example of a retainer used in the tempering step or the annealing step. The retainer 500 has an infrared irradiating function and a cooling function. The retainer 500 includes an upper die 501 having a retaining surface 503 with a shape along one surface of the press-molded article 12, and a lower die 502 having a retaining surface 504 with a shape along the other surface of the press-molded article 12. The upper die 501 has a recess 506 in a region opposed to the portion 14 to be softened of the press-molded article 12. An infrared heater 507 for irradiating infrared light from the side of one surface of the portion 14 is provided in the recess 506. Similarly, the lower die 502 has a recess 508 in a region opposed to the portion 14 to be softened of the press-molded article 12. An infrared heater 509 for irradiating infrared from the side of the other surface of the portion 14 is provided in the recess 508. The upper die 501 and the lower die 502 have a flow path 505 along the retaining surface 503 and the retaining surface 504 for delivering a coolant. Note that, at least one of the upper die 501 and the lower die 502 may not have the flow path 505.

The infrared heater 507 and the infrared heater 509 can be disposed at any place on the retaining surface 503 and the retaining surface 504. For example, as shown in FIG. 3, the infrared heater 507 and the infrared heater 509 can also be disposed at a place opposed to the portion deformed by press-molding during the hot stamping step.

As described above, according to the present embodiment, regions of any size at any location of the press-molded article 12 can be further efficiently softened with infrared light, at the tempering step or the annealing step after the press-molding step.

Note that, in the above-mentioned embodiment, an example has been described in which a region of any size at any location of the press-molded article 12 is irradiated with infrared light at the tempering step or the annealing step after the hot stamping step. However, the press-molded article to be tempered or annealed with infrared irradiation is not limited to a press-molded article formed by hot stamping. For example, the press-molded article to be tempered or annealed with infrared irradiation may be a press-molded article formed by cold-pressing a steel material such as a high strength material.

While the embodiments of the present invention have been described, the technical scope of the invention is not limited to the above described embodiments. It is apparent to persons skilled in the art that various alterations and improvements can be added to the above-described embodiments. It is also apparent from the scope of the claims that the embodiments added with such alterations or improvements can be included in the technical scope of the invention.

The operations, procedures, steps, and stages of each process performed by an apparatus, system, program, and method shown in the claims, embodiments, or diagrams can be performed in any order as long as the order is not indicated by "prior to," "before," or the like and as long as the output from a previous process is not used in a later process. Even if the process flow is described using phrases such as "first" or "next" in the claims, embodiments, or diagrams, it does not necessarily mean that the process must be performed in this order.

EXPLANATION OF REFERENCES

10: blank material, 12: press-molded article, 100: heating furnace, 200: die, 202: upper die, 203, 205: molding surface, 204: lower die, 206: flow path, 300, 400, 500: retainer, 301, 401, 501: upper die, 302, 402, 502: lower die, 303, 304, 403, 404, 503, 504: retaining surface, 305, 405, 505: flow path, 306, 308, 406, 408, 506, 508: recess, 307, 407, 409, 509: infrared heater

What is claimed is:

1. A method for manufacturing a press-molded article, comprising:

molding a blank material which is a steel plate into a press-molded article by sandwiching the blank material between a first molding surface and a second molding surface of a die, and press-molding the blank material into a predetermined shape; and irradiating a predetermined portion of the press-molded article with infrared light after removing the press-molded article from the die, wherein the predetermined portion includes a bent portion with a shape deformed by press-molding, the irradiating comprises:

sandwiching the press-molded article in contact with a first retaining surface and a second retaining surface of a retainer along a shape of the press-molded article, after removing the press-molded article from the die; and irradiating at least the bent portion of the predetermined portion with infrared light from a first infrared irradiating unit provided in a first recess of the first retaining surface opposed to the predetermined portion of the press-molded article, with the press-molded article sandwiched in contact with the first retaining surface and the second retaining surface, and the first infrared irradiating unit includes an infrared heater wherein the irradiating comprises: cooling at least surrounding portions of the predetermined portion of the press-molded article, while irradiating the predetermined portion with the infrared light.

2. The method for manufacturing a press-molded article according to claim 1, wherein the molding comprises:

press-molding the blank material, which is a heated steel plate, into the predetermined shape by sandwiching the blank material between the first molding surface and the second molding surface of the die, and cooling the blank material with the blank material sandwiched between the first molding surface and the second molding surface, in order to mold the blank material into the press-molded article.

3. The method for manufacturing a press-molded article according to claim 1, wherein the infrared heater is disposed along one surface of the predetermined portion.

4. The method for manufacturing a press-molded article according to claim 1, wherein the infrared heater is bent along the bent portion.

5. The method for manufacturing a press-molded article according claim 1, wherein the irradiating comprises:

irradiating the predetermined portion with infrared light from a second infrared irradiating unit provided in a second recess of the second retaining surface opposed to the predetermined portion of the press-molded article, with the press-molded article sandwiched in contact with the first retaining surface and the second retaining surface.

6. The method for manufacturing a press-molded article according to claim 1, wherein the cooling comprises:

cooling at least surrounding portions of the predetermined portion of the press-molded article by delivering a coolant through a flow path provided along at least one of the first retaining surface and the second retaining surface of the retainer.

7. The method for manufacturing a press-molded article according to claim 1, wherein the predetermined portion includes a portion of the blank material deformed due to press-molding by the die.

8. The method for manufacturing a press-molded article according to claim 1, wherein the infrared light is near-infrared light.

* * * * *